US008018396B2

(12) United States Patent
Yu

(10) Patent No.: US 8,018,396 B2
(45) Date of Patent: Sep. 13, 2011

(54) DUAL-RESONANCE RETRACTABLE ANTENNA

(75) Inventor: Yao-Wen Yu, Pa-Te (TW)

(73) Assignee: Auden Techno Corp., Pa-Te, Tao-Yuan Hsien (TW)

( * ) Notice: Subject to any disclaimer, the term of this patent is extended or adjusted under 35 U.S.C. 154(b) by 420 days.

(21) Appl. No.: 12/222,821

(22) Filed: Aug. 18, 2008

(65) Prior Publication Data

US 2010/0039349 A1 Feb. 18, 2010

(51) Int. Cl.
*H01Q 1/10* (2006.01)

(52) U.S. Cl. ..... 343/901; 343/715

(58) Field of Classification Search ..... 343/714, 343/715, 718, 745, 750, 789, 790, 808, 812, 343/813, 823, 841, 861, 863, 883, 888, 889, 343/900, 901

See application file for complete search history.

(56) References Cited

U.S. PATENT DOCUMENTS

| | | | | |
|---|---|---|---|---|
| 5,686,927 | A * | 11/1997 | Simmons | 343/702 |
| 5,739,790 | A * | 4/1998 | Green, Jr. | 343/702 |
| 6,195,050 | B1 * | 2/2001 | Kim | 343/700 MS |
| 2006/0220964 | A1 * | 10/2006 | Tefiku | 343/702 |

* cited by examiner

*Primary Examiner* — Douglas W Owens
*Assistant Examiner* — Jae Kim
(74) *Attorney, Agent, or Firm* — Guice Patents PLLC

(57) ABSTRACT

A dual-resonance retractable antenna including a connector, a telescopic radiating device mounted on the connector, and a radiating tube mounted on the connector around the tubular outer radiating element of the telescopic radiating device and electrically isolated from the telescopic radiating device. The telescopic radiating device is movable between an extended position and a retracted position, the dual-resonance retractable antenna can oscillate at two different resonance frequencies, having multi-band multi-system capabilities for multiplex application.

5 Claims, 6 Drawing Sheets

DUAL-RESONANCE RETRACTABLE ANTENNA

BACKGROUND OF THE INVENTION

1. Field of the Invention

The present invention relates to a retractable antenna and more particularly, to a dual-resonance retractable antenna.

2. Description of the Related Art

A regular retractable antenna is generally comprised of an outer tube and one or multiple inner tubes (for example, one outer tube 11 and one inner tube 12 as shown in FIG. 2). The inner tube can be moved out of the outer tube to extend the length of the antenna. However, conventional retractable antennas are simply for oscillation at a specific resonance frequency. By means of manually adjusting the length of the antenna, the frequency shift is controlled (see FIG. 1).

Following fast development of communication equipments, antenna is required to effectively achieve automation and to have multi-band multi-system capabilities for multiplex application. However, regular retractable antennas cannot achieve the requirements.

To solve the aforesaid problem, retractable antenna may be provided with a connector at the top side for the connection of an external antenna for signal transmission at a second frequency band. However, this arrangement is not to achieve the desired multi-frequency function by means of changing the arrangement of the retractable antenna itself but by means of attaching an external antenna for signal transmission at a second frequency band. This design is inconvenient in use.

Therefore, it is desirable to provide a retractable antenna that eliminates the aforesaid drawbacks.

SUMMARY OF THE INVENTION

The present invention has been accomplished under the circumstances in view. According to one aspect of the present invention, the dual-resonance retractable antenna comprises a connector, a telescopic radiating device mounted on the connector, and a radiating tube mounted on the connector around the tubular outer radiating element of the telescopic radiating device and electrically isolated from the telescopic radiating device. By means of moving the telescopic radiating device between the extended position and the received position, the dual-resonance retractable antenna can oscillate at two different resonance frequencies, having multi-band multi-system capabilities for multiplex application.

According to another aspect of the present invention, the dual-resonance retractable antenna further comprises an insulative tube sleeved onto the tubular outer radiating element of the telescopic radiating device and fixedly connected to the top end of the radiating tube to hold the tubular outer radiating element in place and to let the yr be moved between the extended position and the received position. The insulative tube prevents direct contact between the radiating tube and the telescopic radiating device and, provides a decorative effect.

DETAILED DESCRIPTION OF THE PREFERRED EMBODIMENT

Figure 1:
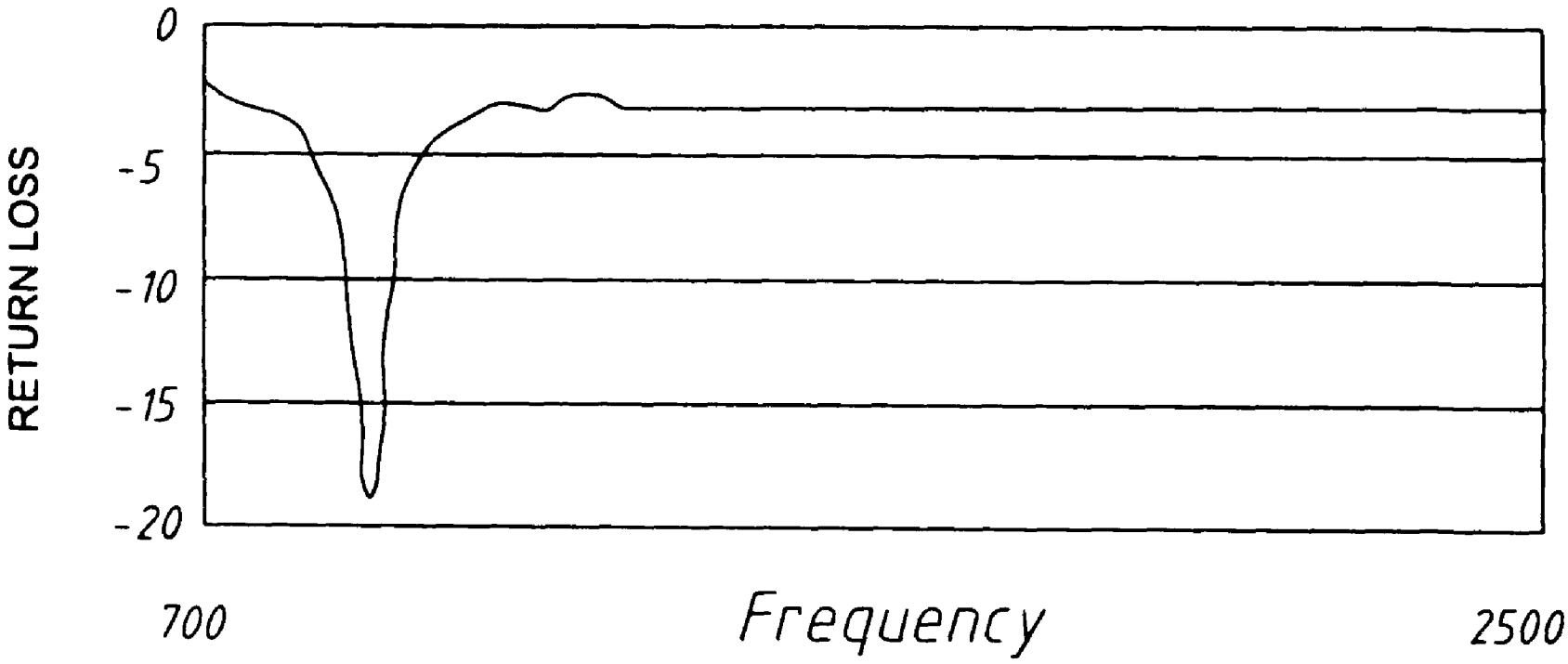
FIG. 1 Prior Art
FIG. 1 is a schematic return loss diagram of a conventional retractable antenna.
Figure 2:
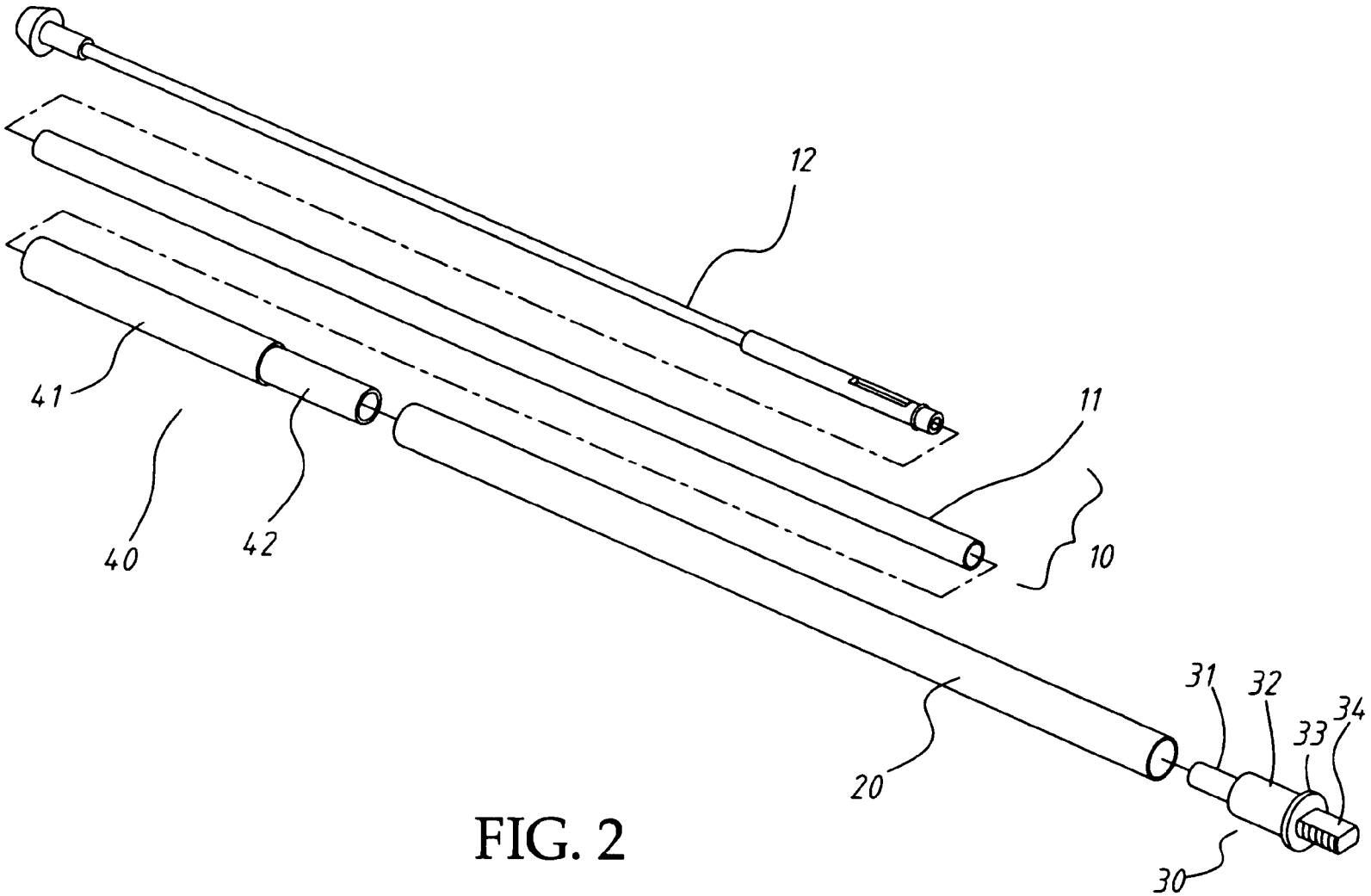
FIG. 2 is an exploded view of a dual-resonance retractable antenna in accordance with the present invention.
Figure 3:
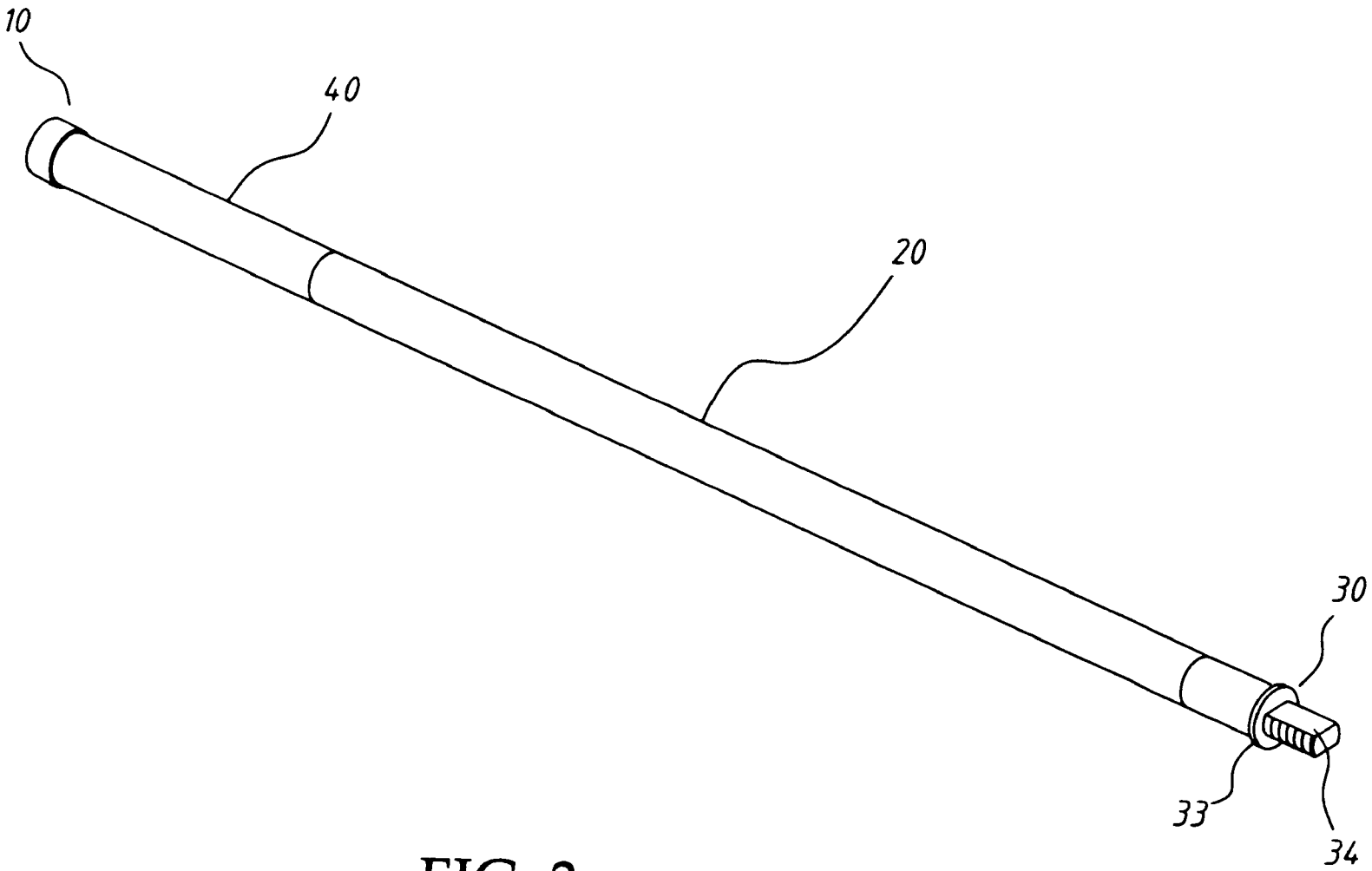
FIG. 3 is an elevational assembly view of the dual-resonance retractable antenna in accordance with the present invention.
Figure 4:
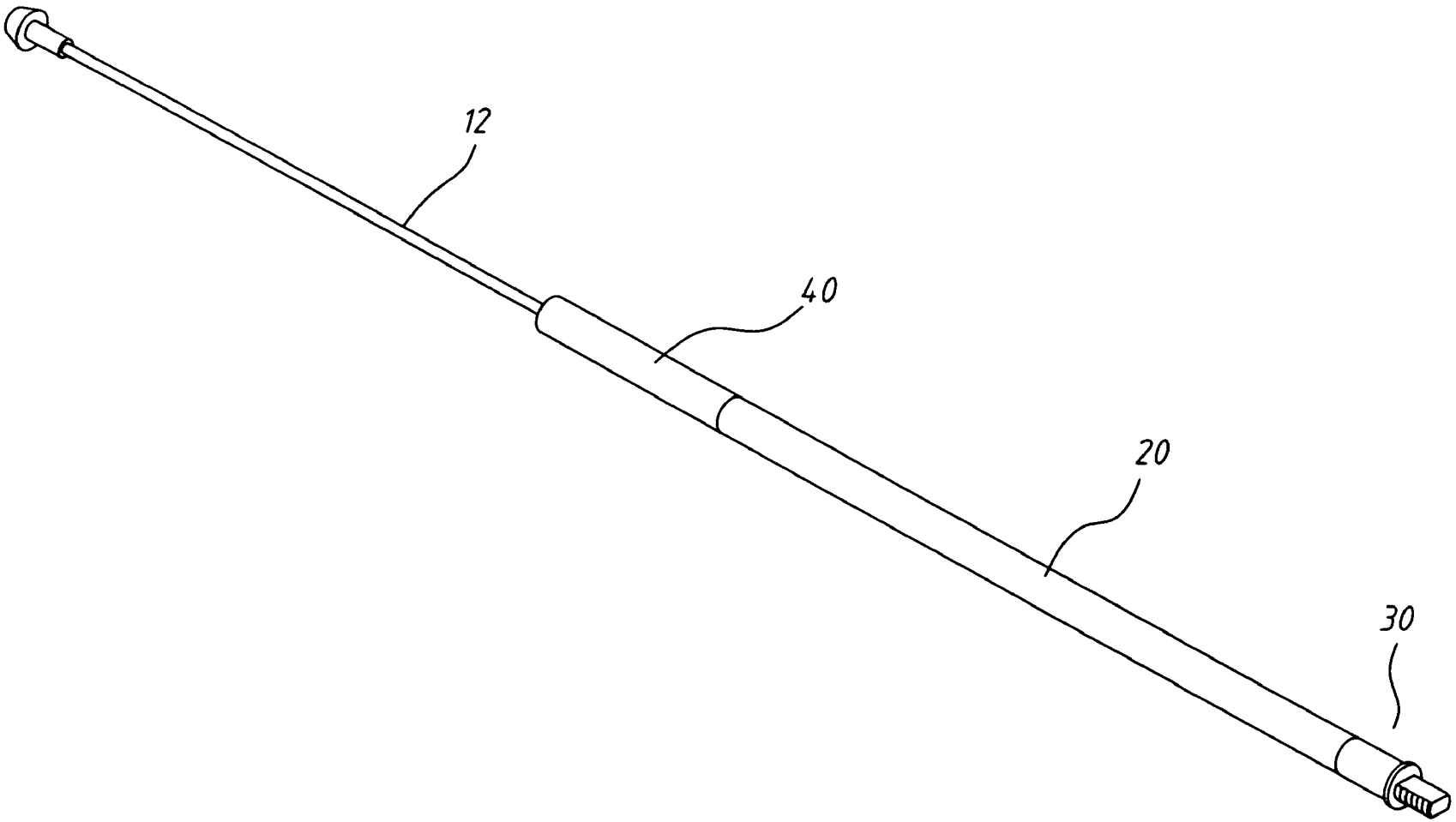
FIG. 4 is an elevational assembly view of the present invention, showing an extended status of the dual-resonance retractable antenna.
Figure 5:
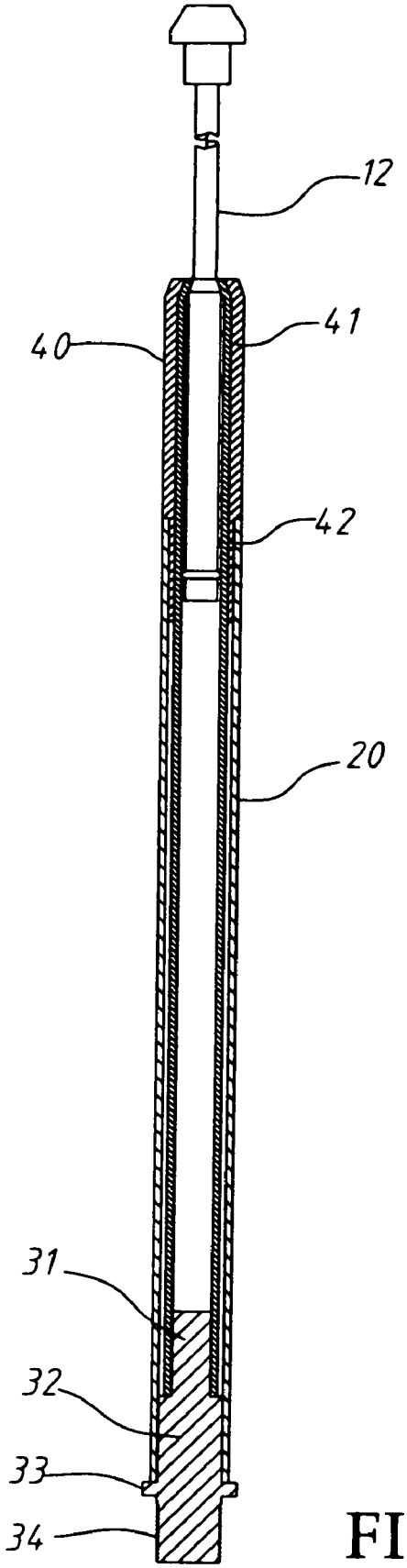
FIG. 5 is a sectional view of the present invention, showing an extended status of the dual-resonance retractable antenna.

Referring to FIGS. 2~5, a dual-resonance retractable antenna in accordance with the present invention is shown comprising a telescopic radiating device 10, a radiating tube 20, a connector 30, and an insulative tube 40.

The telescopic radiating device 10 is made of an electrically conducting material, comprising a tubular outer radiating element 11 and an inner radiating element 12. The inner radiating element 12 is mounted in the tubular outer radiating element 11 in such a manner that the inner radiating element 12 is axially movable in and out of the tubular outer radiating element 11 between the received position shown in FIG. 3 and the extended position shown in FIG. 4. This structural arrangement is similar to a conventional telescopic rod antenna having only one resonance frequency.

The radiating tube 20 is made of an electrically conducting material sleeved onto the tubular outer radiating element 11 in a parallel manner and electrically isolated from the tubular outer radiating element 11 by the insulative tube 40.

The connector 30 is a metal conductive member comprising a cylindrical body 32 press-fitted into the bottom end of the radiating tube 20, a front extension rod 31 axially forwardly extending from the center of the top end of the cylindrical body 32 and press-fitted into the bottom end of the tubular outer radiating element 11, a stop flange 33 extending around the periphery of the bottom end of the cylindrical body 32 and stopped against the bottom end of the radiating tube 20, and a screw rod 34 axially backwardly extending from the bottom end of the cylindrical body 32 for connection to a communication electronic device for signal transmission.

The insulative tube 40 is a stepped tube having an upper part 41 with a relatively greater outer diameter and a lower part 42 with a relatively smaller outer diameter. The insulative tube 40 has an inner diameter adapted for the insertion and positioning of the upper part of the tubular outer radiating element 11 of the telescopic radiating device 10. The insulative tube 40 keeps the telescopic radiating device 10 and radiating tube 20 in parallel and provides a decorative effect as well.

Figure 6:
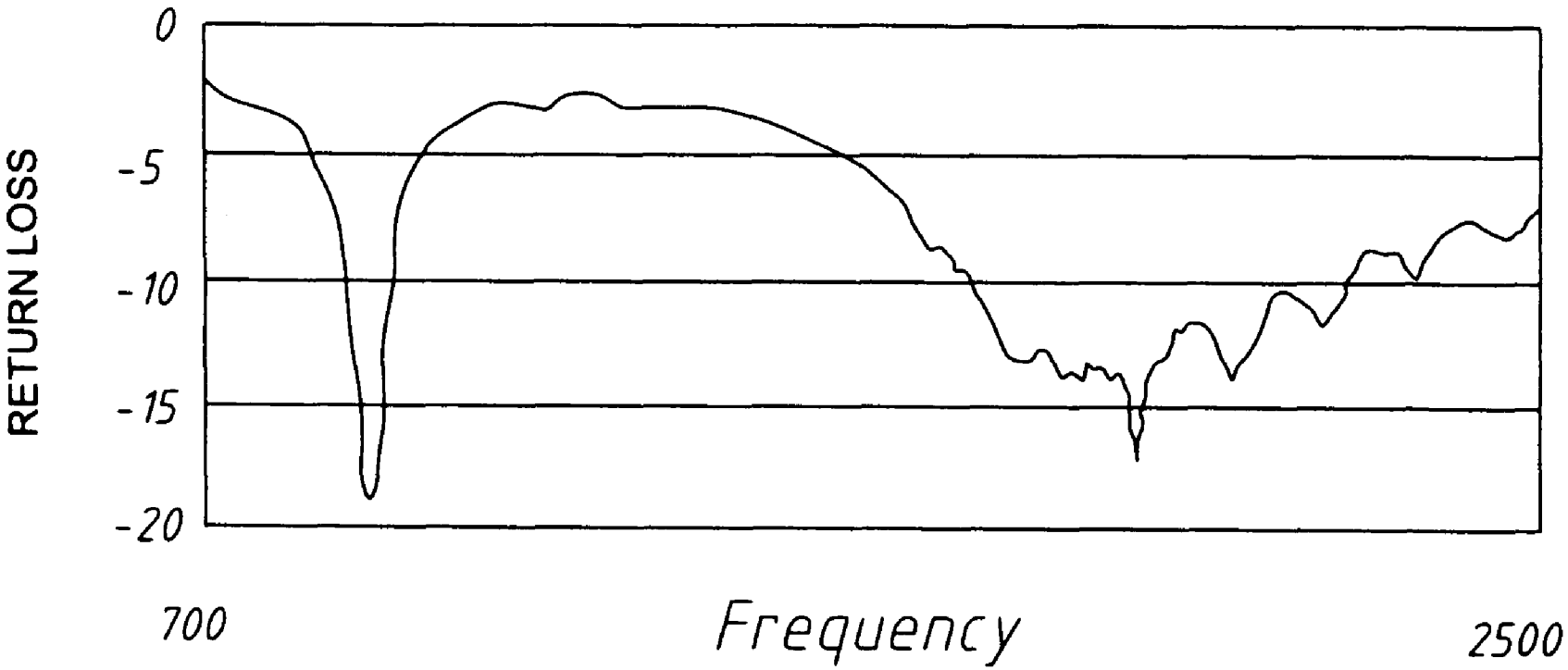
FIG. 6 is a schematic return loss diagram of the dual-resonance retractable antenna in accordance with the present invention.

By means of the telescopic radiating device 10 and radiating tube 20, the length of the dual-resonance retractable antenna is adjustable to selectively provide two different resonance frequencies. FIG. 6 is a schematic return loss diagram of the dual-resonance retractable antenna in accordance with the present invention. As illustrated, the dual-resonance retractable antenna oscillates at the resonance frequency 900 MHz as well as the resonant frequency 1800 MHz. Subject to the aforesaid structural design, the dual-resonance retractable antenna of the present invention has multi-band multi-system capabilities practical for multiplex application. When compared to the prior art technique shown in FIG. 1, the invention involves non-obviousness/inventive step.

Although a particular embodiment of the invention has been described in detail for purposes of illustration, various modifications and enhancements may be made without departing from the spirit and scope of the invention. For example, the telescopic radiating device 10 can be formed of more than two radiating elements that slide one inside another; the length design of the telescopic radiating device 10 and the radiating tube 20 may be changed. Accordingly, the invention is not to be limited except as by the appended claims.

The invention claimed is:

1. A dual-resonance retractable antenna, comprising:

a telescopic radiating device made of an electrically conducting material, said telescopic radiating device comprising a tubular outer radiating element and at least one inner radiating element slidably inserted into an interior of said tubular outer radiating element and being movable in and out between an extended position and a retracted position;

a radiating tube made of a metal conductive material, said tubular outer radiating element of said telescopic radiating device being located in an interior of said radiating tube;

a connector made of an electrically conducting material, said connector comprising a cylindrical body and a front extension rod axially forwardly extending from a front end of said cylindrical body, an outer diameter of said cylindrical body is larger than an outer diameter of said front extension rod; said cylindrical body being press-fitted into an interior of a bottom end of said radiating tube and said front extension rod being press-fitted into an interior of a bottom end of said tubular outer radiating element of said telescopic radiating device; and an insulative tube fixedly connected to a top end of said radiating tube, a top portion of said tubular outer radiating element of said telescopic radiating device being located in an interior of said insulative tube, said insulative tube fixing said tubular outer radiating element of said telescopic radiating device in place, said at least one inner radiating element being movable in and out of said tubular outer radiating element and said insulative tube between said extended position and said retracted position, said insulative tube electrically isolating said radiating tube from said telescopic radiating device;

wherein said at least one inner radiating element is slidable in and out of said tubular outer radiating element to adjust the length of the dual-resonance retractable antenna, enabling the dual-resonance retractable antenna to oscillate at two different resonance frequencies.

2. The dual-resonance retractable antenna as claimed in claim 1, wherein said connector further comprises a stop flange extending around the periphery of a bottom end of said cylindrical body and stopped outside the bottom end of said radiating tube.

3. The dual-resonance retractable antenna as claimed in claim 2, wherein said connector further comprises a screw rod axially backwardly extending from the bottom end of said cylindrical body.

4. The dual-resonance retractable antenna as claimed in claim 1, wherein said insulative tube is a stepped tube having an upper part and a lower part, an outer diameter of said upper part is larger than an outer diameter of said lower part, said lower part being press-fitted into a top end of said radiating tube, said lower part of said insulative tube is located between said radiating tube and said tubular outer radiating element of said telescopic radiating device.

5. The dual-resonance retractable antenna as claimed in claim 1, wherein said insulative tube and said connector fixing said tubular outer radiating element of said telescopic radiating device relative to said radiating tube.

* * * * *